US012687363B2

(12) United States Patent
Askerlund et al.

(10) Patent No.: US 12,687,363 B2
(45) Date of Patent: Jul. 21, 2026

(54) FIREARM ACCESSORY SYSTEM AND DEVICE

(71) Applicant: Impact, Inc., Sandy, UT (US)

(72) Inventors: Justin Askerlund, Sandy, UT (US); Tavin Williams, Sandy, UT (US)

(73) Assignee: Impact, Inc., Sandy, UT (US)

( * ) Notice: Subject to any disclaimer, the term of this patent is extended or adjusted under 35 U.S.C. 154(b) by 57 days.

(21) Appl. No.: 18/241,034

(22) Filed: Aug. 31, 2023

(65) Prior Publication Data

US 2025/0075994 A1 Mar. 6, 2025

(51) Int. Cl.
*F41A 21/36* (2006.01)
*F41A 21/32* (2006.01)

(52) U.S. Cl.
CPC ..... *F41A 21/36* (2013.01); *F41A 21/325* (2013.01)

(58) Field of Classification Search
CPC ..... F41A 21/36; F41A 21/325
See application file for complete search history.

(56) References Cited

U.S. PATENT DOCUMENTS 3,978,762 A * 9/1976 Khaidurov ..... F41A 21/36 89/14.3
4,479,418 A * 10/1984 Beretta ..... F41A 21/30 89/14.4
4,691,614 A * 9/1987 Leffel ..... F41A 21/36 89/14.3
5,136,924 A * 8/1992 Forster ..... F41A 21/30 89/14.4
8,393,108 B1 * 3/2013 Wilson ..... F41G 11/003 42/111
8,819,980 B2 * 9/2014 Geissele ..... F41C 23/16 42/75.01
8,857,096 B2 * 10/2014 McClintock ..... F41G 11/003 42/72
9,103,618 B2 * 8/2015 Daniel ..... F41A 5/26
9,115,950 B2 * 8/2015 Bethlenfalvy ..... F41A 21/30
9,273,930 B2 * 3/2016 Jiminez ..... F41G 11/003
9,470,480 B2 * 10/2016 Kirchhoff ..... F41G 11/001
9,784,519 B2 * 10/2017 Fischer ..... F41G 11/003
D806,818 S * 1/2018 Major ..... D22/108
9,939,224 B2 * 4/2018 Fischer ..... F41A 21/30
10,018,440 B2 * 7/2018 Shults ..... F41A 21/30
10,234,237 B1 * 3/2019 Jager ..... F41A 21/36
10,254,085 B2 * 4/2019 Willmann ..... F41G 11/004
10,337,820 B2 * 7/2019 Jager ..... F41A 21/36
10,488,138 B2 * 11/2019 Johansen ..... F41A 21/30
10,677,554 B2 * 6/2020 Thomas ..... F41C 3/00
(Continued)

*Primary Examiner* — Michelle Clement
(74) *Attorney, Agent, or Firm* — Travis Banta; Ascent IP Law, LLC

(57) ABSTRACT

A firearm compensator includes an upper section comprising a lower section. The upper section has vents and a muzzle. The lower section, connected to the upper section, includes attachment ports. A mount is removably attached to the firearm compensator and includes a platform and one or more support. The platform includes one or more coupling points. One or more supports are attached to the platform. The one or more supports include one or more coupling points removably attached to the one or more attachment ports of the firearm compressor. A system includes a firearm compensator and a thumb rest. The thumb includes an arm comprising a stage, and one or more arm junction points.

17 Claims, 13 Drawing Sheets

(56) References Cited

U.S. PATENT DOCUMENTS

| | | | | |
|---|---|---|---|---|
| 10,767,952 | B1 * | 9/2020 | Till | F41A 21/325 |
| 10,876,807 | B2 * | 12/2020 | Christandl | F41A 21/30 |
| 10,890,400 | B2 * | 1/2021 | Christandl | F41A 21/325 |
| 11,105,577 | B1 * | 8/2021 | Thomas | F41A 3/40 |
| 11,441,869 | B2 * | 9/2022 | Zimmer | F41C 23/04 |
| 11,480,414 | B2 * | 10/2022 | Salinas | F41A 21/36 |
| 11,835,314 | B2 * | 12/2023 | Walker | F41A 21/30 |
| 11,874,078 | B2 * | 1/2024 | Roe | F41A 21/325 |
| 12,104,870 | B2 * | 10/2024 | Roe | F41A 21/36 |
| 12,140,405 | B2 * | 11/2024 | Kilic | F41G 11/00 |
| 2014/0157640 | A1 * | 6/2014 | Whelan | F41C 23/16 89/14.4 |
| 2016/0010935 | A1 * | 1/2016 | Clarke | F41A 21/28 29/896.2 |
| 2018/0347933 | A1 * | 12/2018 | Molina | F41A 35/02 |
| 2019/0086173 | A1 * | 3/2019 | Lee | F41A 21/325 |
| 2019/0101350 | A1 * | 4/2019 | Hall | F41A 21/325 |
| 2019/0128632 | A1 * | 5/2019 | Christandl | F41A 21/30 |
| 2023/0296343 | A1 * | 9/2023 | Janse Van Rensburg | F41A 21/30 89/14.4 |
| 2023/0341206 | A1 * | 10/2023 | Christandl | F41A 21/325 |
| 2023/0392902 | A1 * | 12/2023 | Tiller | F41C 27/00 |
| 2024/0110758 | A1 * | 4/2024 | Roe | F41G 1/02 |
| 2024/0191960 | A1 * | 6/2024 | Toner | F41A 21/36 |
| 2024/0401897 | A1 * | 12/2024 | Roe | F41A 21/325 |
| 2024/0401912 | A1 * | 12/2024 | Salinas | F41A 21/30 |
| 2025/0003710 | A1 * | 1/2025 | Eaton | F41A 21/36 |
| 2025/0085075 | A1 * | 3/2025 | Underwood | F41A 21/36 |

* cited by examiner

FIREARM ACCESSORY SYSTEM AND DEVICE

BACKGROUND

A muzzle brake is a device attached to the muzzle of a firearm to reduce recoil and muzzle rise. The muzzle break works by redirecting gases produced upon firing, which helps to counteract the forces that push the firearm backward and upward. The history of firearm muzzle brakes dates back several decades and has evolved along with advancements in firearms technology.

The earliest known form of recoil reduction device can be traced back to the late 19th century. During this time, firearms manufacturers and inventors started experimenting with various designs to mitigate recoil and improve shooting accuracy. One of the earliest examples was the Maxim Silencer, developed by Hiram Maxim in 1888. Although primarily designed as a sound suppressor, it featured internal baffles that helped reduce recoil to some extent.

In the early 20th century, firearms designers began focusing more on reducing muzzle rise and recoil in order to improve rapid-fire accuracy. Notable inventors and gunsmiths experimented with different muzzle brake designs. These early muzzle brakes often featured slotted or ported designs to direct gas upward or to the sides, effectively countering muzzle rise and reducing recoil.

As firearm technology advanced and semi-automatic and automatic firearms became more prevalent, the demand for effective recoil-reduction devices increased. Manufacturers started incorporating muzzle brakes as integral parts of their firearm designs. For example, the Browning Hi-Power pistol, introduced in the 1930s, featured a built-in muzzle brake that helped control muzzle rise and recoil.

In the mid-20th century, firearms competitions and practical shooting sports gained popularity, further driving the development and refinement of muzzle brake designs. Competitive shooters sought ways to reduce recoil and improve shooting speed while maintaining accuracy. This led to the introduction of highly efficient muzzle brakes, such as the Miculek Compensator developed by renowned shooter Jerry Miculek. This muzzle brake utilized multiple chambers and precision engineering to redirect gases and significantly reduce recoil and muzzle rise.

In recent years, advancements in engineering and manufacturing techniques have allowed for the development of even more efficient muzzle brakes. Modern muzzle brakes often feature complex internal geometries, angled baffles, and multiple ports or vents. These designs effectively redirect gases in a way that counters the upward and backward forces generated upon firing, resulting in improved control and faster follow-up shots.

Today, muzzle brakes are widely used in various firearm applications, including competition shooting, tactical and self-defense firearms, and even military applications. They have become an integral part of many firearms designs, offering shooters improved recoil management, faster target reacquisition, and enhanced shooting performance. However, muzzle brakes often require costly firearm alterations. For example, a user may need to drill into the firearm to attach a muzzle break. A muzzle break may require a new threaded firearm muzzle to attach. These types of installations can be costly and time-consuming. Moreover, additional firearm accessories often need the same type of invasive, cost-prohibitive, and time-consuming installations.

SUMMARY OF THE DISCLOSURE

Disclosed herein is a device comprising a firearm compensator. The firearm compensator includes an upper section comprising a lower section. The upper section has one or more vents and a muzzle. The lower section, connected to the upper section, includes one or more attachment ports.

A system that includes a firearm compensator and a mount. The firearm compensator includes an upper section comprising a lower section. The upper section has one or more vents and a muzzle. The mount is removably attached to the firearm compensator and includes a platform and one or more support. The platform includes one or more coupling points. One or more supports are attached to the platform comprising. One or more supports include one or more coupling points removably attached to the one or more attachment ports of the firearm compressor.

A system that includes a firearm compensator and a thumb rest. The firearm compensator includes an upper section comprising a lower section. The upper section has one or more vents and a muzzle. The thumb includes an arm comprising that has a stage, and one or more arm junction points.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. The advantages of the disclosure will become better understood with regard to the following description and accompanying drawings where.

DETAILED DESCRIPTION

In the following description of the disclosure, reference is made to the accompanying drawings, which form a part hereof, and in which are shown by way of illustration-specific implementations in which the disclosure may be practiced. It is understood that other implementations may be utilized and structural changes may be made without departing from the scope of the disclosure.

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure may be alternatively included in another embodiment or figure regardless of whether or not those elements are shown or described in another embodiment or figure. In other words, elements in the figures may be interchangeable between various embodiments disclosed herein, whether shown or not.

Figure 1:
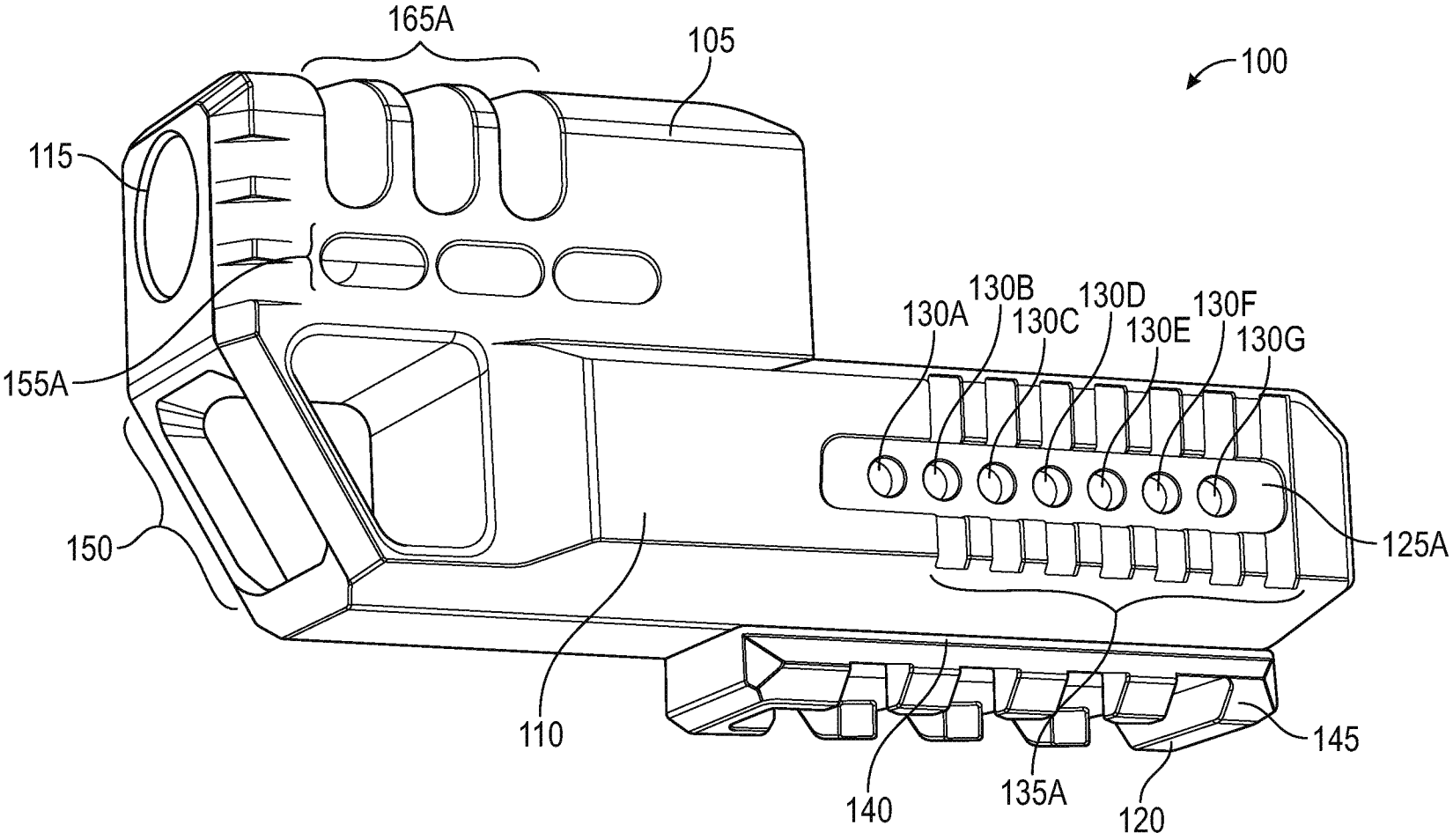
FIG. 1 illustrates a left-side view of a compensator.
Figure 5:
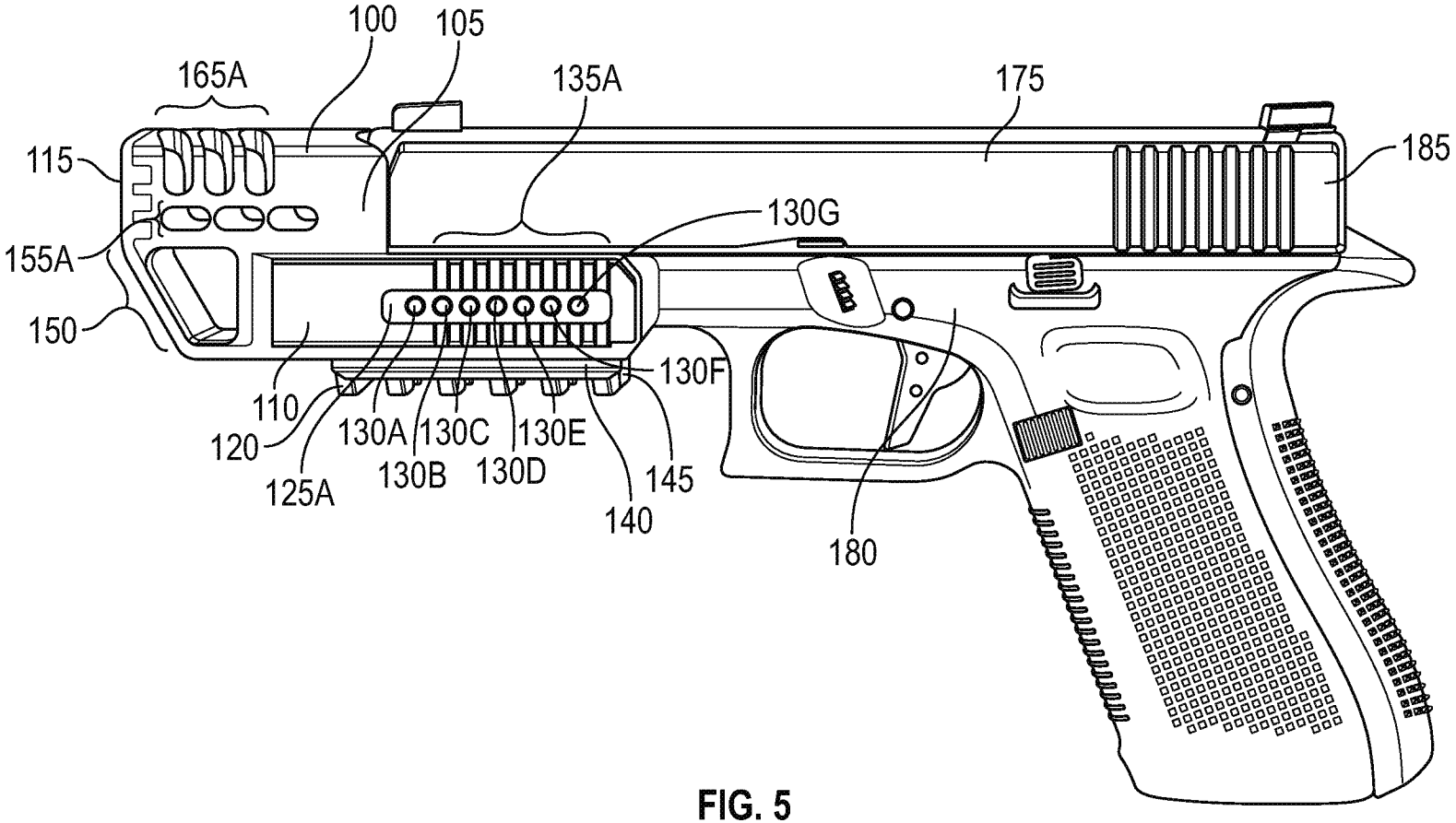
FIG. 5 illustrates a left-side view of a compensator attached to a firearm.

FIG. 1 illustrates a left-side view of compensator 100. Compensator 100 includes top section 105 and bottom section 110. Top section 105 may include top vents 165A and 165B (vents 165B are not shown due to perspective) and side vents 155A and 155B (vents 155B are not shown due to perspective). Vents 165A-B and 155A-B are used to dispel the rush of air created when a bullet is expelled out the muzzle of a firearm and out of muzzle 115. Muzzle 115 may be positioned on the distal end of top section 105 of compensator 100. When attached to a firearm top section 105 may be in line with the upper section of the firearm such that the muzzle of the firearm is in line with muzzle 115 of compensator 100. The proximal end of top section 105 may be shaped to accommodate the curvature of the firearm. This may include a curved portion located on the proximal end of the top section (as seen in FIG. 5).

At the distal end of bottom section 110 may include receiver 150 to provide an area of attachment for slings, holsters, optics, or other accessories known in the art. Receiver 150 may include openings on the right, the left, and the front distal end of bottom section 110. Receiver 150 may also provide a place within compensator 100 to reduce weight. Alternatively, receiver 150 may also include vents. Proximally to receiver 150 bottom section 110 may include left and right attachment channels 125A-B (channel 125B is not seen due to perspective but depicted in FIG. 2). Channels 125A-B may inset within bottom section 110 such that the outermost edge of bottom section 110 is extended outward at a first level and channels 125A-B are inset at a second level that is extended outward less than the first level. This inset may help align accessories to the appropriate location to facilitate attachment. Within channels 125A-B are attachment ports 130A-N. Attachment ports 130A-G may be disposed in channel 125A. Channels 125A-B may be rounded on both ends and may accommodate a variety of accessories. Attachment ports 130H-N may dispose within channel 125B. Any number of attachment ports 130A-N may be disposed within channels 125A-B. Further, attachment ports 130A-N may be comprised of one or more of threaded, apertures, magnets, and other connectors known in the art.

Figure 2:
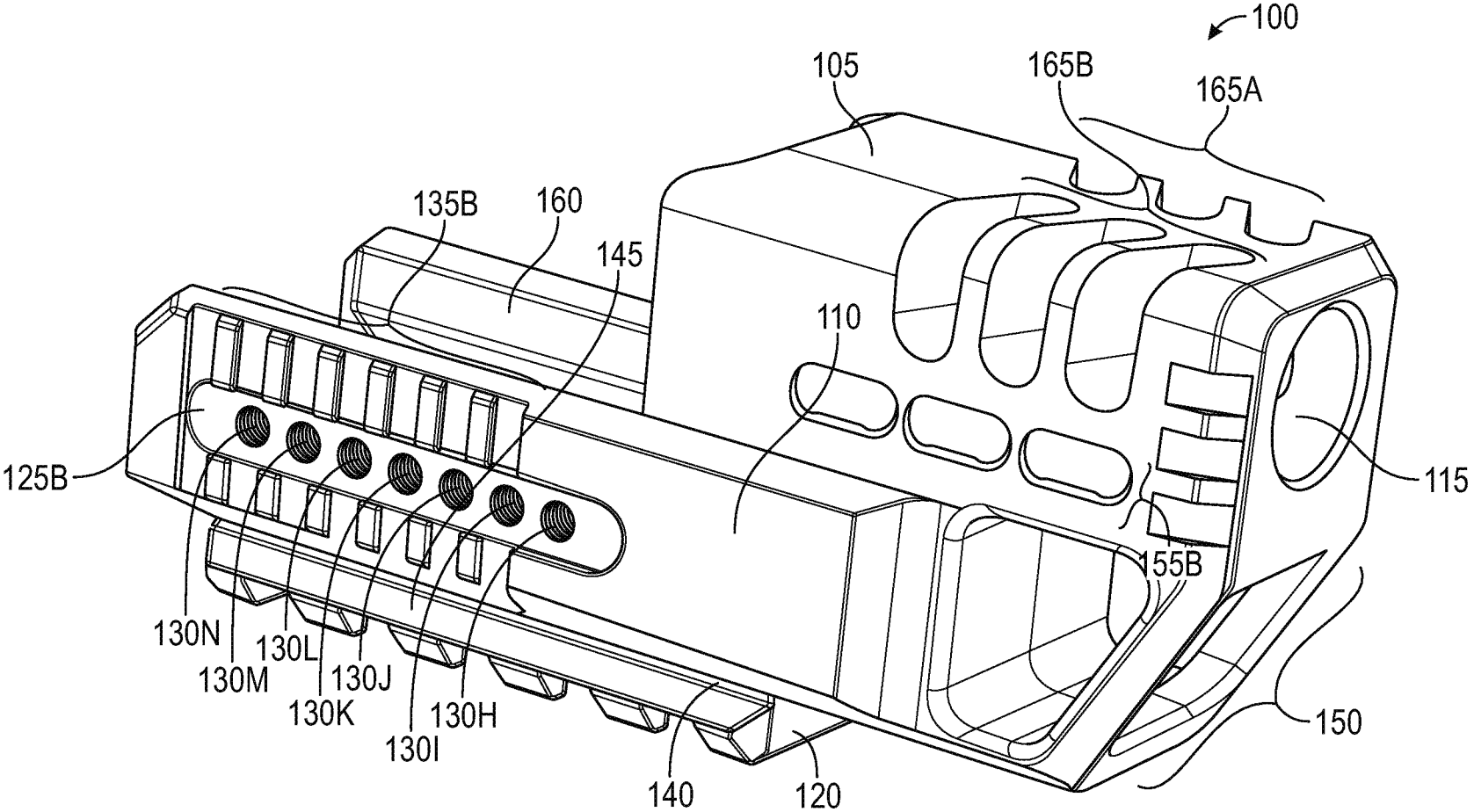
FIG. 2 illustrates a right perspective view of a compensator.

Bottom section 110 may also include one or more grooves 135A-B for grip and weight reduction. Grooves 135B are not seen in FIG. 1 due to perspective but are depicted in FIG. 2. One or more grooves 135A and 135B may run substantially perpendicular to channels 125A and 125B. Grooves 135A-B may be comprised of two levels outside level and inside level. The outside level may extend outward from the center of bottom section 110 and may be in line with the outside edge of bottom section 110. The inside level may extend inward at a level higher than that of channels 125A-B. Alternatively, a lower-level portion of grooves 135A-B may be at the same level as channels 125A-B.

The underside of bottom section 110 may include rail 120. Rail 120 may removably attach to bottom section 110 and may include base 140 and grooves 145 that extends outward from bottom section 110. The type of rail 120 may include one or more of a dovetail rail, Warsaw Pact rail, weaver rail, Picatinny rail, NATO accessory rail, or a modular lock rail. Rail 120 may include connecting port that allow rail 120 to removably attach to bottom section 110.

FIG. 2 illustrates a right perspective view of a compensator 100. Compensator 100 includes top section 105 and bottom section 110. Top section 105 may include top vents 165A and 165B and side vents 155A and 155B (vents 155A not shown due to perspective). Vents 165A-B and 155A-B are used to dispel the rush of air created when a bullet is expelled out the muzzle of a firearm and out of muzzle 115. Muzzle 115 may be positioned on the distal end of top section 105 of compensator 100. When attached to a firearm top section 105 may be in line with the upper section of the firearm such that the muzzle of the firearm is in line with muzzle 115 of compensator 100. The proximal end of top section 105 may be shaped to accommodate the curvature of the firearm. This may include a curved portion located on the proximal end of compensator 100 (as seen in FIG. 5).

Bottom section 110, at the distal end, may include receiver 150 to provide an area of attachment for slings, holsters, optics, or other accessories known in the art. Receiver 150 may include openings on the right, the left, and the front distal end of bottom section 110. Receiver 150 may also provide a place within compensator 100 to reduce weight. Alternatively, receiver 150 may also include vents. Proximally to receiver 150, bottom section 110 may include left and right attachment channels 125A-B (channel 125A is not seen due to perspective but is depicted in FIG. 1). Channels 125A-B may inset within bottom section 110 such that the outermost edge of bottom section 110 is extended outward at a first level and channels 125A-B are inset at a second level that is extended outward less than the first level. This inset may help align accessories to the appropriate location to facilitate attachment. Additionally, channels 125A-B may be rounded on both ends to help accommodate a variety of accessories. Within channels 125A-B are attachment ports 130A-N. Attachment ports 130A-G may be disposed in channel 125A. Attachment ports 130H-N may dispose within channel 125B. Any number of attachment ports 130A-N may be disposed within channels 125A-B. Further, attachment ports 130A-N may be comprised of one or more of threaded, apertures, magnets, and other connectors known in the art.

Bottom section 110 may also include one or more grooves 135A-B for grip and weight reduction. Grooves 135B are not seen in FIG. 1 due to perspective but are depicted in FIG. 2. One or more grooves 135A and 135B may run substantially perpendicular to channels 125A and 125B. Grooves 135A-B may be comprised of two levels outside level and inside level. The outside level may extend outward from the center of bottom section 110 and may be in line with the outside edge of bottom section 110. The inside level may extend inward at a level higher than that of channels 125A-B. Alternatively, a lower-level portion of grooves 135A-B may be at the same level as channels 125A-B. At the proximal end of bottom section 110 may include firearm receiving port 160 that is sized to receive the distal end of a firearm.

The underside of bottom section 110 may include rail 120. Rail 120 may removably attach to bottom section 110 and may include base 140 and grooves 145 that extends outward from bottom section 110. The type of rail 120 may include one or more of a dovetail rail, Warsaw Pact rail, weaver rail, Picatinny rail, NATO accessory rail, or a modular lock rail. Rail 120 may include connecting port that allow rail 120 to removably attach to bottom section 110.

Figure 3:
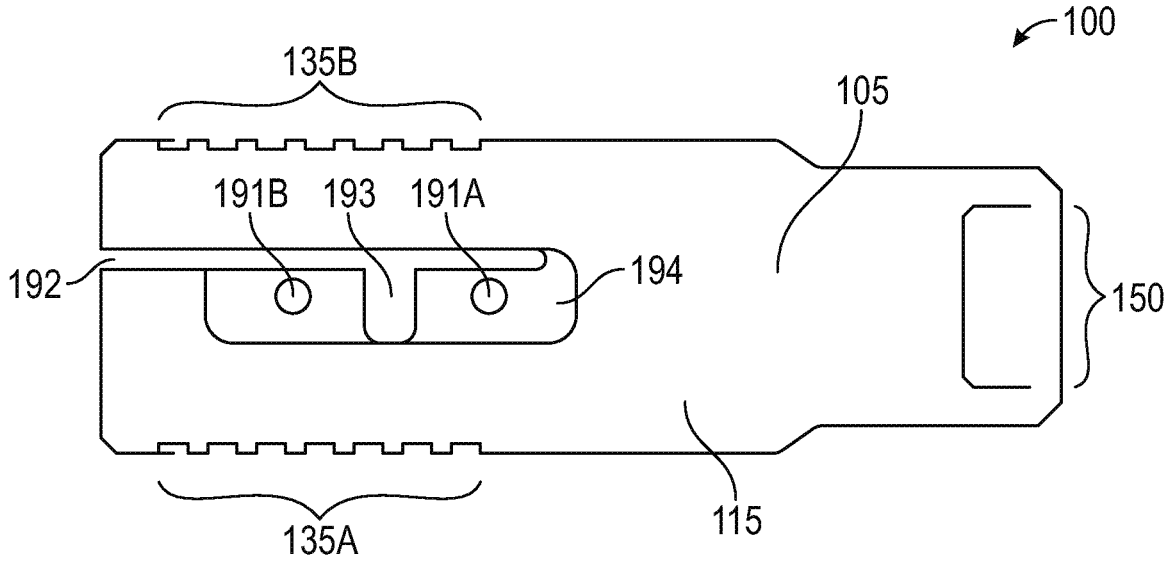
FIG. 3 illustrates a bottom view of a compensator without a rail.
Figure 4A:
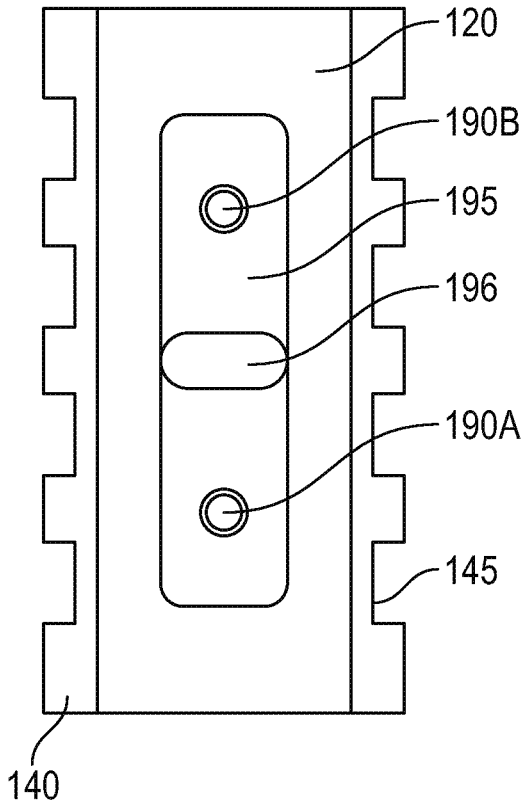
FIG. 4A illustrates a top view of a rail.
Figure 4B:
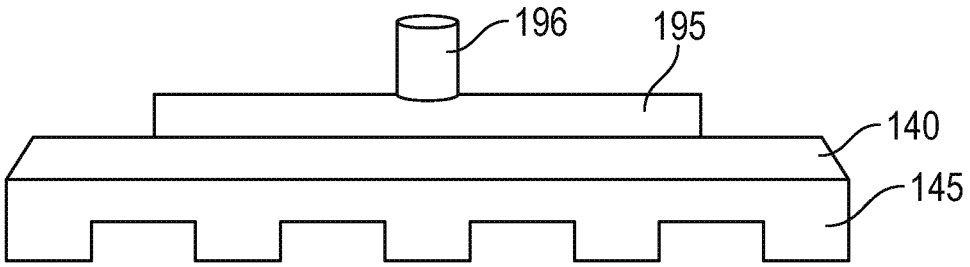
FIG. 4B illustrates a bottom view of a rail.

FIG. 3 illustrates a bottom view of compensator 100 without rail 120. (Rail 120 as depicted in FIGS. 1, 2, 4, 5, 8, 10, and 11). The shape of the openings may be sized to fit a rail 120 as described in FIGS. 4A-C. Compensator 100 may include linking ports 191A-B to correspond with linking ports 190A-B (seen in FIGS. 8, 4A, and 4C). Compensator 100 may also include slit 192 that runs substantially parallel with the length of compensator 100. Slit 192 may connect at one point to slot 193 may open to slit 192 and whose length may run perpendicular to the length of slit 192. The size of slot 193 may be sized to mate with key 196 (as seen in FIGS. 4A-B). Slit 192 may be installed to allow some flexing during installation or allow for expansion due to heat during use. Slit 192 may also be installed to reduce weight. Linking ports 191A-B, slit 192, and slot 193 may be positioned within depression 194 inset within the bottom section 110 of compensator 100. Depression 194 may be sized to receive platform 195 (as seen in FIGS. 4A-B).

Grooves 135A-B may also be included to help the user maintain a good grip and/or reduce weight. The distal end of bottom section 110 may include receiver 150 to provide an area of attachment for slings, holsters, optics, or other accessories known in the art. Receiver 150 may include openings on the right, the left, and the front distal end of bottom section 110. Receiver 150 may also provide a place within compensator 100 to reduce weight. Further, receiver 150 may also include air vents to dispel the rush of air created when a bullet is fired.

Figure 4C:
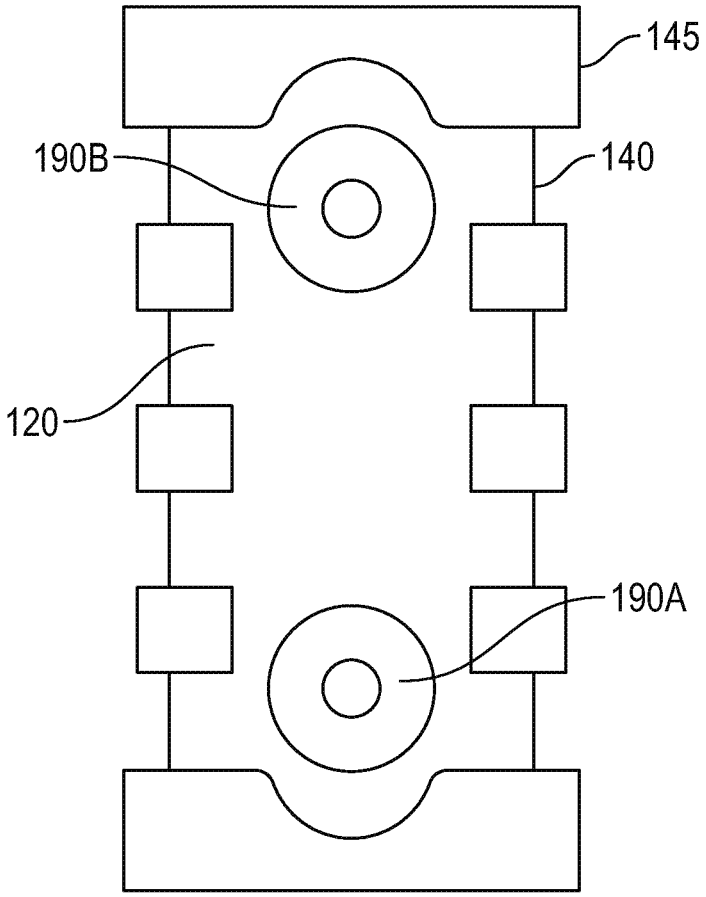
FIG. 4C illustrates a side view of a rail.

FIGS. 4A, 4B, and 4C illustrate a top, bottom, and side view of rail 120. Rail 120 may include base 140 and grooves 145. Rail 120 may also include platform 195 which may be sized to be received into depression 194 (as seen in FIG. 3). Key 196 may be positioned on top of platform 195 and may be sized to mate with slot 193. Key 196 may extend off platform 195 and be sized to slide through slot 193 to be positioned within a groove of a rail of the firearm. The width of key 196 is sized to fit within a depression of the firearm rail to help secure the compensator in place by inhibiting the forward and backward movement.

FIG. 5 illustrates a left-side view of compensator 100 attached to firearm 175. Compensator 100 includes top section 105 and bottom section 110. Top section 105 may include top vents 165A and 165B (top vents 165B are not shown due to perspective but are depicted in FIG. 2) and side vents 155A and 155B (side vents 155B are not shown due to perspective but are depicted in FIG. 2). Vents 165A-B and 155A-B are used to dispel the rush of air created when a bullet is expelled out the muzzle of a firearm and out of muzzle 115. Muzzle 115 may be positioned on the distal end of top section 105 of compensator 100. When attached to a firearm top section 105 may be in line with the upper section of the firearm such that the muzzle of the firearm is in line with muzzle 115 of compensator 100. The proximal end of top section 105 may be shaped to accommodate the curvature of the firearm. This may include a curved portion located on the proximal end of the top section (as seen in FIG. 5).

At the distal end of bottom section 110 may include receiver 150 to provide an area of attachment for slings, holsters, optics, or other accessories known in the art. Receiver 150 may include openings on the right, the left, and the front distal end of bottom section 110. Receiver 150 may also provide a place within compensator 100 to reduce weight. Alternatively, receiver 150 may also include vents. Proximally to receiver 150 bottom section 110 may include left and right attachment channels 125A-B (channel 125B is not seen due to perspective but depicted in FIG. 2). Channels 125A-B may inset within bottom section 110 such that the outermost edge of bottom section 110 is extended outward at a first level and channels 125A-B are inset at a second level that is extended outward less than the first level. This inset may help align accessories to the appropriate location to facilitate attachment. Within channels 125A-B are attachment ports 130A-N. Attachment ports 130A-G may be disposed in channel 125A.

Bottom section 110 may also include one or more grooves 135A-B for grip and weight reduction. Grooves 135B are not seen in FIG. 1 due to perspective but are depicted in FIG. 2. One or more grooves 135A and 135B may run substantially perpendicular to channels 125A and 125B. Grooves 135A-B may be comprised of two levels outside level and inside level. The outside level may extend outward from the center of bottom section 110 and may be in line with the outside edge of bottom section 110. The inside level may extend inward at a level higher than that of channels 125A-B. Alternatively, a lower-level portion of grooves 135A-B may be at the same level as channels 125A-B.

The underside of bottom section 110 may include rail 120. Rail 120 may removably attach to bottom section 110 and may include base 140 and grooves 145 that extends outward from bottom section 110. The type of rail 120 may include one or more of a dovetail rail, Warsaw Pact rail, weaver rail, Picatinny rail, NATO accessory rail, or a modular lock rail. Rail 120 may include connecting port that allow rail 120 to removably attach to bottom section 110.

Figure 6:
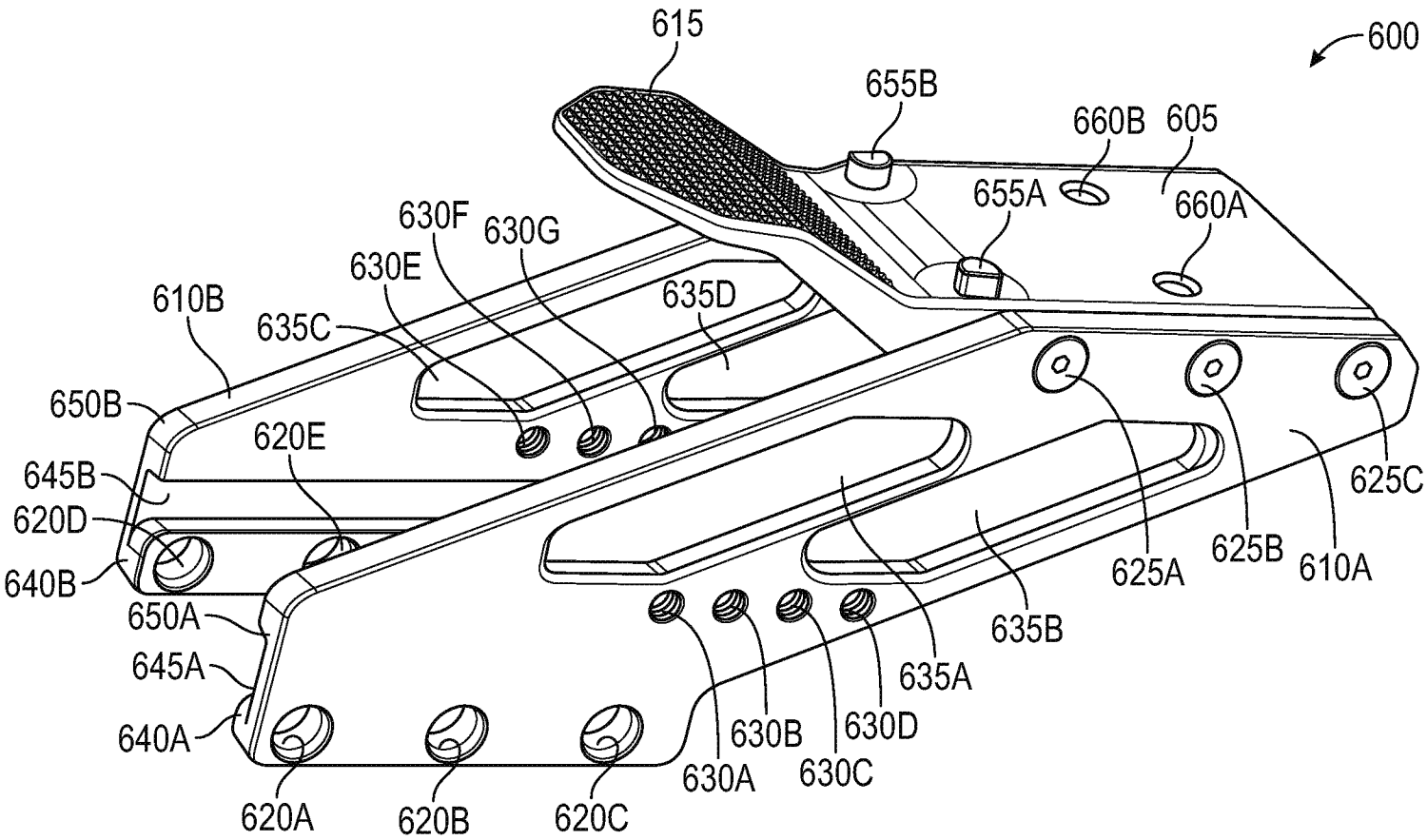
FIG. 6 illustrates a left-side perspective view of a mount.
Figure 7:
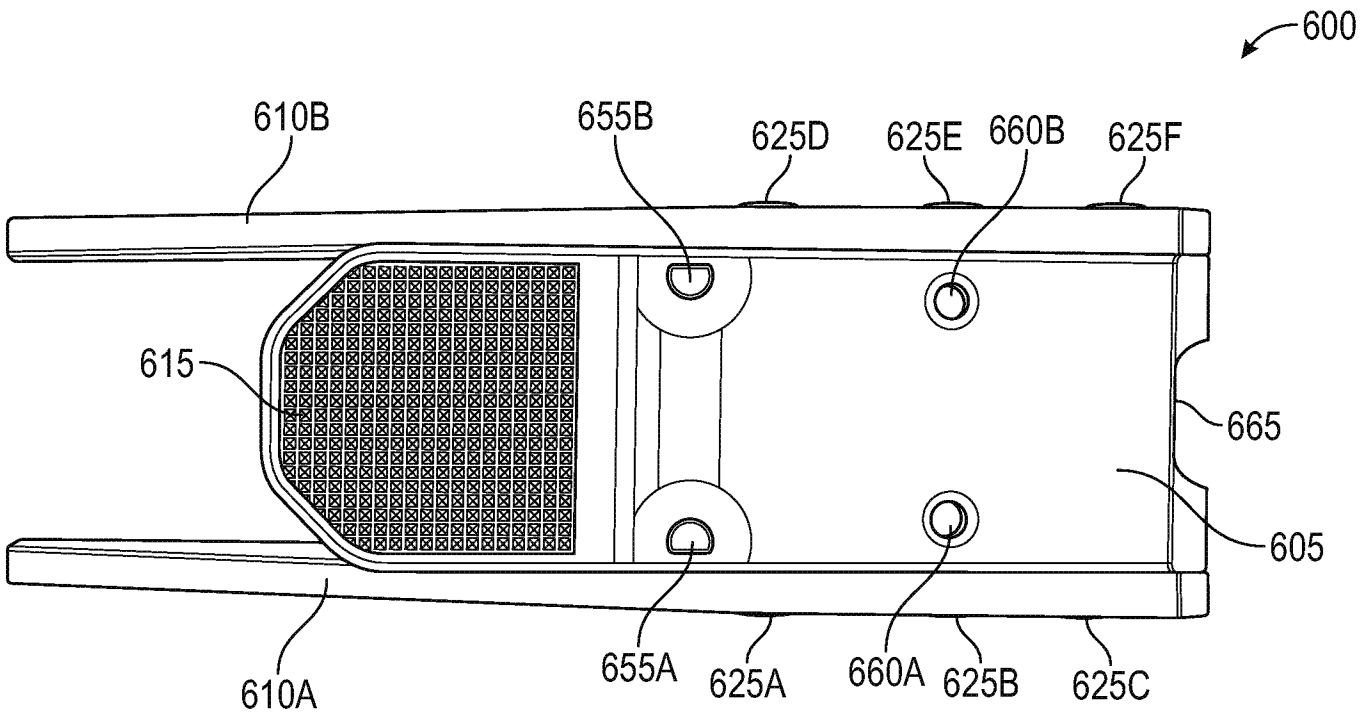
FIG. 7 illustrates a top view of a mount.

FIG. 6 illustrates a right-perspective view of mount 600. Mount 600 may include first support 610A and second support 610B. Support 610A may include support apertures 635A-B. Second support 610B may include support apertures 635C-D. Support apertures 635A-D may help to reduce weight and allow air to flow to and from the firearm. The upper portion of supports 610A-B may attach to platform 605 using upper coupling points 625A-F (upper coupling points 625D-F are not shown due to perspective but are depicted in FIG. 7). The lower end of supports 610A-B may include lower coupling points 620A-F (lower coupling point 620F is not shown due to perspective). Lower coupling points 620A-F may facilitate attachment to a firearm.

Lower coupling points 620A-F may be disposed in bumpers 640A-B and may have a certain thickness greater than mount channels 645A-B. Bumper 640A may be attached to support 610A and bumper 640B may be attached to support 610B. Bumpers 640A-B may be sized to mate with channels 125A-B respectively (channels 125A-B are depicted in FIGS. 1-3). Supports 610A-B may also include mount channels 645A-B disposed respectively in supports 610A-B. Mount channels 645A-B may be positioned above bumpers 640A-B. The length of mount channels 645A-B may run parallel to the length of bumpers 640. Alternatively, mount channels 645A-B may be positioned on the outside of supports 610A-B. Above mount channels 645A-B are crowns 650A-B where supports 610A-B resume a thickness greater than that of mount channels 645A-B. The thickness of crowns 250A-B extends upwards and may include one or more middle coupling points 630A-H (middle coupling point 630H is not shown due to perspective). Middle coupling points 630A-H may facilitate the attachment of various accessories like a flashlight, a laser, a thumb rest, etc. The crown may extend up to upper coupling points 625A-F where supports 610A-B attach to platform 605.

Platform 605 may include distal coupling points 655A-B and proximal coupling points 660A-B. Coupling points 655A-B may be posts that extend upward off of platform 605 and may further include a flat portion of the post on the outside edge of the coupling points 655A-B. Distal and proximal coupling points 655A-B and 660A-B may allow an accessory to be attached to platform 605. The accessory may include a flashlight, laser, and/or optics, etc. Platform 605 may also include shield 615 that extends distally off of platform 605 to help protect the accessory attached to platform 605. The first portion of shield 615 may extend upward from platform 605 at a first angle and the second portion of shield 615 may extend outward at a second angle. Further, the surface of shield 615 may be textured to facilitate the attachment of one or more accessories to platform 605. Further, the distal end of shield 615 may include a rounded end by smoothing out the edges and removing outside corners to follow the contours of the firearm and/or accessory and facilitating holstering of the firearm.

FIG. 7 illustrates a top view of a mount 600. Mount 600 may include first supports 610A, second support 610B, and attached to platform 605 using upper coupling 625A-F. Platform 605 may include distal coupling points 655A-B and proximal coupling points 660A-B. Distal and proximal coupling points 655A-B and 660A-B may be posts, apertures, magnets, friction-based locking mechanisms, or other connection systems known in the art. One or more distal or proximal coupling points 655A-B and 660A-B may facilitate the connection of one or more accessories. Further, platform 605 may include cut-out 665 to reduce weight and to conform to the contours of an accessory and/or the firearm it is attached to.

Platform 605 may also include shield 615 that extends at a distally off of platform 605 to help protect the accessory attached to platform 605. The first portion of shield 615 may extend upward from platform 605 at a first angle and the second portion of shield 615 may extend outward at a second angle. Further, the surface of shield 615 may be textured to facilitate the attachment of one or more accessories to platform 605. Additionally, the distal end of shield 615 may include a rounded end by smoothing out the edges and removing outside corners to follow the contours of the firearm and/or accessory and facilitating holstering of the firearm.

Figure 8:
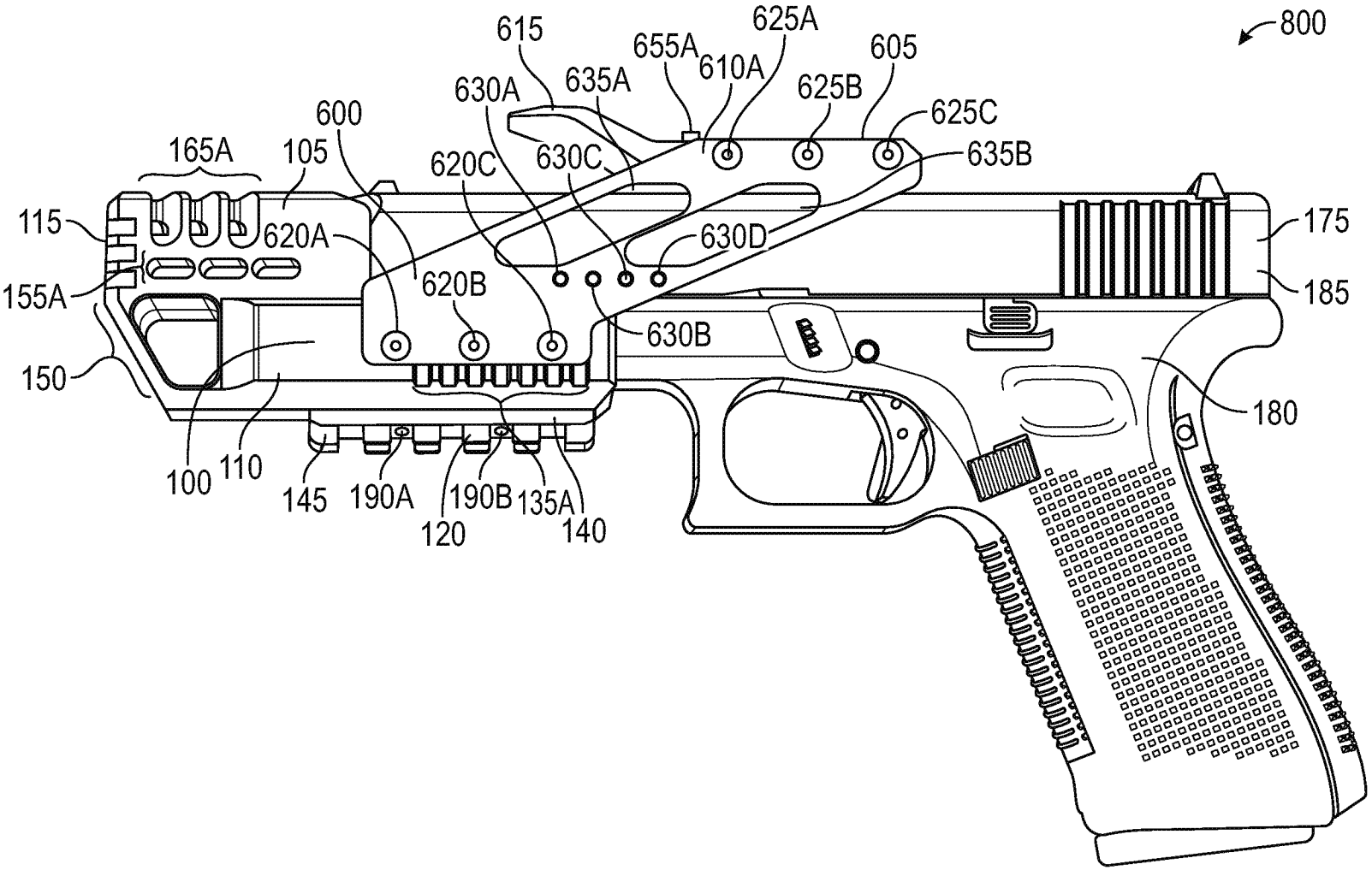
FIG. 8 illustrates a left-side view of a firearm accessory system.

FIG. 8 illustrates a left-side view of a firearm accessory system 800 including compensator 100 and mount 600 attached to firearm 175. Compensator 100 includes top section 105 and bottom section 110. Top section 105 may include top vents 165A and 165B (vents 165B are not shown due to perspective) and side vents 155A and 155B (vents 155B are not shown due to perspective). Vents 165A-B and 155A-B are used to dispel the rush of air created when a bullet is expelled out the muzzle of a firearm and out of muzzle 115. Muzzle 115 may open to the distal end of compensator 100. When attached to firearm 175 top section 105 may be in line with upper section 185 of the firearm such that the muzzle of the firearm is in line with muzzle 115 of compensator 100. At the proximal end of top section 105 may be shaped, such as a curved portion as depicted, to accommodate the shape of the firearm to be attached.

At the distal end of bottom section 110 may include receiver 150 to provide an area of attachment for slings, holsters, optics, or other accessories known in the art. Receiver 150 may include openings on the right, the left, and the front distal end of bottom section 115. When attached to firearm 175 bottom section 110 may be in line with lower section 180 of the firearm receiver 150 may also provide a place within compensator 100 to reduce weight. Proximally to receiver 150 bottom section 110 may include left and right attachment channels 125A-B (channel 125B is not seen due to perspective but depicted in FIG. 2). Channels 125A-B may inset within bottom section 110 such that the outermost edge of bottom section 115 is extended outward at a first level and channels 125A-B are inset at a second level that is extended outward less than the first level. This inset may help align accessories to the appropriate location to facilitate attachment. Within channels 125A-B are attachment ports 130A-N. Attachment ports 130A-G may be disposed in channel 125A. Channels 125A-B may be rounded on both ends and may accommodate a variety of accessories. Attachment ports 130H-N may dispose within channel 125B. Any number of attachment ports 130A-N may be disposed within channels 125A-B. Further, attachment ports 130A-N may be comprised of one or more of threaded, apertures, magnets, and other connectors known in the art.

Bottom section 110 may also include one or more grooves 135A-B for grip and weight reduction. Grooves 135B are not seen in FIG. 1 due to perspective but are depicted in FIG. 2. One or more grooves 135A and 135B may run substantially perpendicular to channels 125A and 125B. Grooves 135A-B may be comprised of two levels outside level and inside level. The outside level may extend outward from the center of bottom section 110 and may be in line with the outside edge of bottom section 115. The inside level may extend inward at a level higher than that of channels 125A-B. Alternatively, a lower-level portion of grooves 135A-B may be at the same level as channels 125A-B.

The underside of bottom section 110 may include rail 120. Rail 120 may removably attach to bottom section 110 and may include base 140 and grooves 145 that extends outward from bottom section 110. The type of rail 120 may include one or more of a dovetail rail, Warsaw Pact rail, weaver rail, Picatinny rail, NATO accessory rail, or a modular lock rail. Rail 120 may include connecting port that allow rail 120 to removably attach to bottom section 110.

Attached to firearm 175 using one or of lower coupling points 620A-F mount 600 may attach to firearm 175. Support 610A may include support apertures 635A-B. Second support 610B may include support apertures 635C-D. Support apertures 635A-D may help to reduce weight and allow air to flow to and from the firearm. The upper portion of supports 610A-B may attach to platform 605 using upper coupling points 625A-F (upper coupling points 625D-F are not shown due to perspective but are depicted in FIG. 7). The lower end of supports 610A-B may include lower coupling points 620A-F (lower coupling point 620F is not shown due to perspective). Lower coupling points 620A-F may facilitate attachment to a firearm.

Lower coupling points 620A-F may be disposed in bumpers 640A-B and may have a certain thickness greater than mount channels 645A-B. Bumper 640A may be attached to support 610A and bumper 640B may be attached to support 610B. Bumpers 640A-B may be sized to mate with channels 125A-B respectively (channels 125A-B are depicted in FIGS. 1-3). Supports 610A-B may also include mount channels 645A-B disposed respectively in supports 610A-B. Mount channels 645A-B may be positioned above bumpers 640A-B. The length of mount channels 645A-B may run parallel to the length of bumpers 640. Alternatively, mount channels 645A-B may be positioned on the outside of supports 610A-B. Above mount channels 645A-B are crowns 650A-B where supports 610A-B resume a thickness greater than that of mount channels 645A-B. The thickness of crowns 250A-B extends upwards and may include one or more middle coupling points 630A-H (middle coupling point 630H is not shown due to perspective). Middle coupling points 630A-H may facilitate the attachment of various accessories like a flashlight, a laser, a thumb rest, etc. The crown may extend up to upper coupling points 625A-F where supports 610A-B attach to platform 605.

Platform 605 may include distal coupling points 655A-B and proximal coupling points 660A-B. Distal and proximal coupling points 655A-B and 660A-B may allow an accessory to be attached to platform 605. The accessory may include a flashlight, laser, and/or optics, etc. Platform 605 may also include shield 615 that extends distally off of platform 605 to help protect the accessory attached to platform 605. The first portion of shield 615 may extend upward from platform 605 at a first angle and the second portion of shield 615 may extend outward at a second angle. Further, the surface of shield 615 may be textured to facilitate the attachment of one or more accessories to platform 605. Further, the distal end of shield 615 may include a rounded end by smoothing out the edges and removing outside corners to follow the contours of the firearm and/or accessory and facilitating holstering of the firearm.

Figure 9:
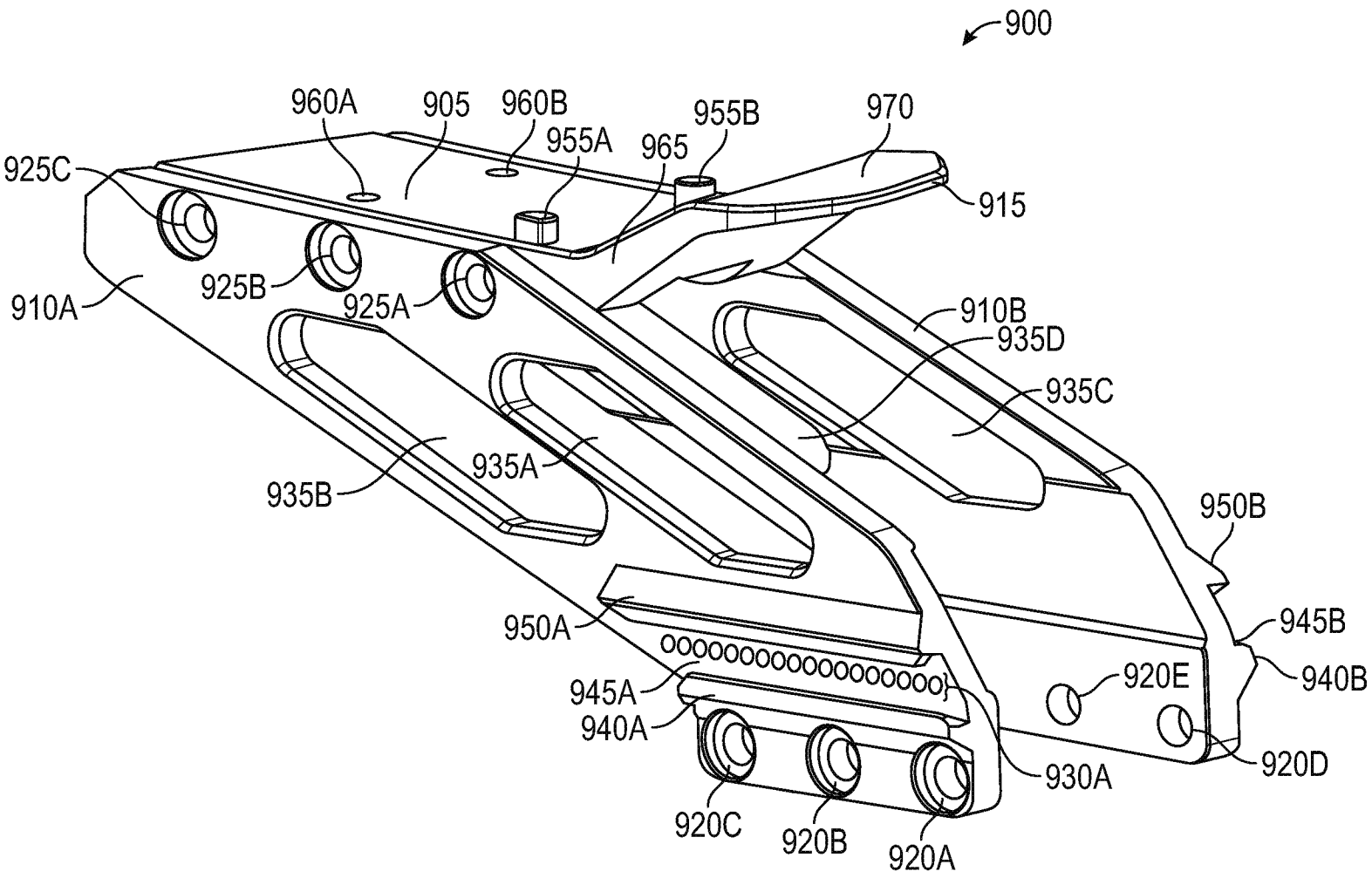
FIG. 9 illustrates a left-side perspective side view of a mount.
Figure 13:
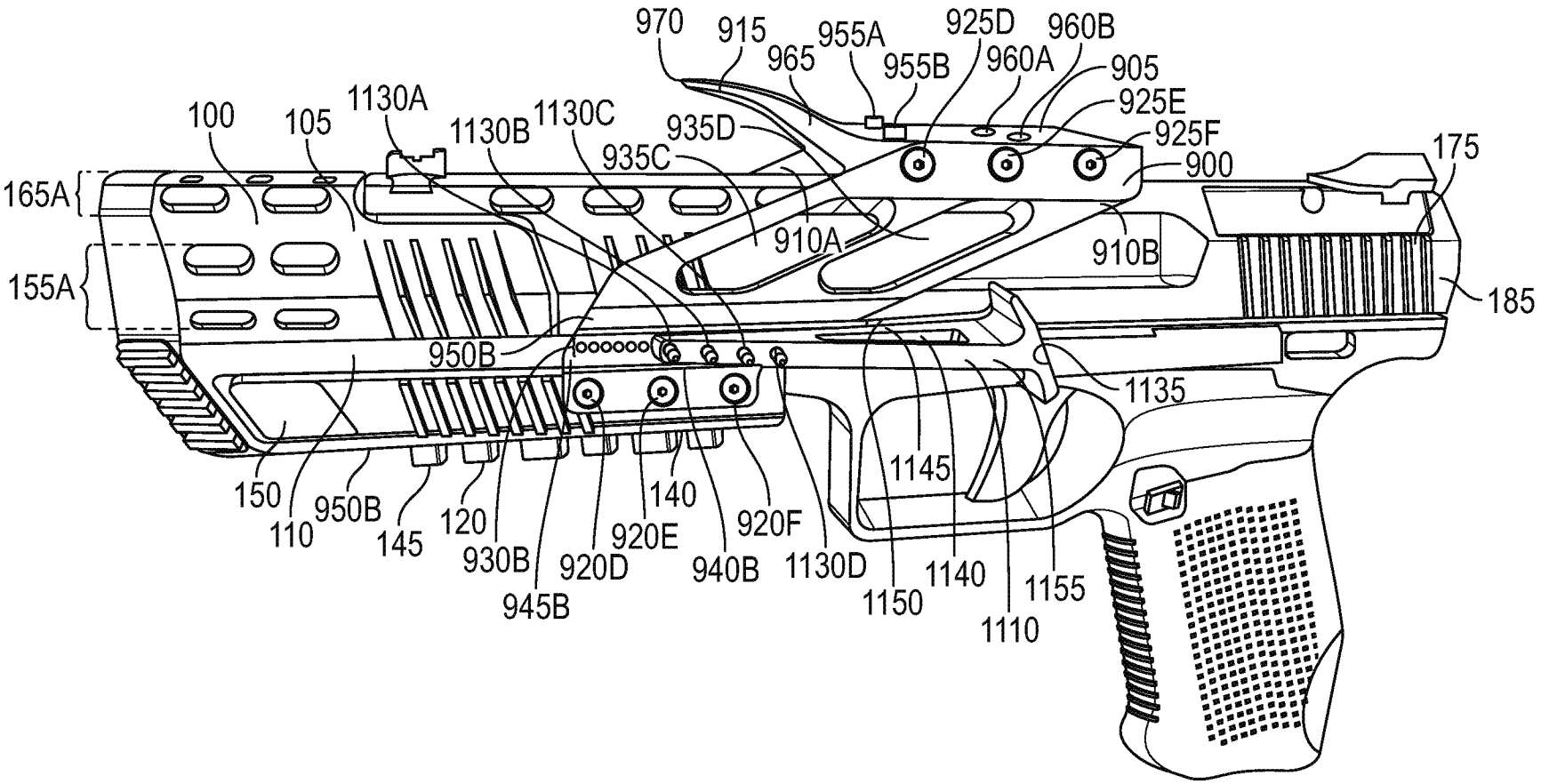
FIG. 13 illustrates a side view of a firearm accessory system.

FIG. 9 illustrates a left-side perspective view of mount 900. Mount 900 may include first support 910A and second support 910B. Support 910A may include support apertures 935A-B. Second support 910B may include support apertures 935C-D. Support apertures 935A-D may help to reduce weight and allow air to flow to and from the firearm. The upper portion of supports 910A-B may attach to platform 905 using upper coupling points 925A-F (upper coupling points 925D-F are not shown due to perspective but are depicted in FIG. 13). The lower end of supports 910A-B may include lower coupling points 920A-F (lower coupling point 920F is not shown due to perspective). Lower coupling points 920A-F may facilitate attachment to a firearm.

Figure 11:
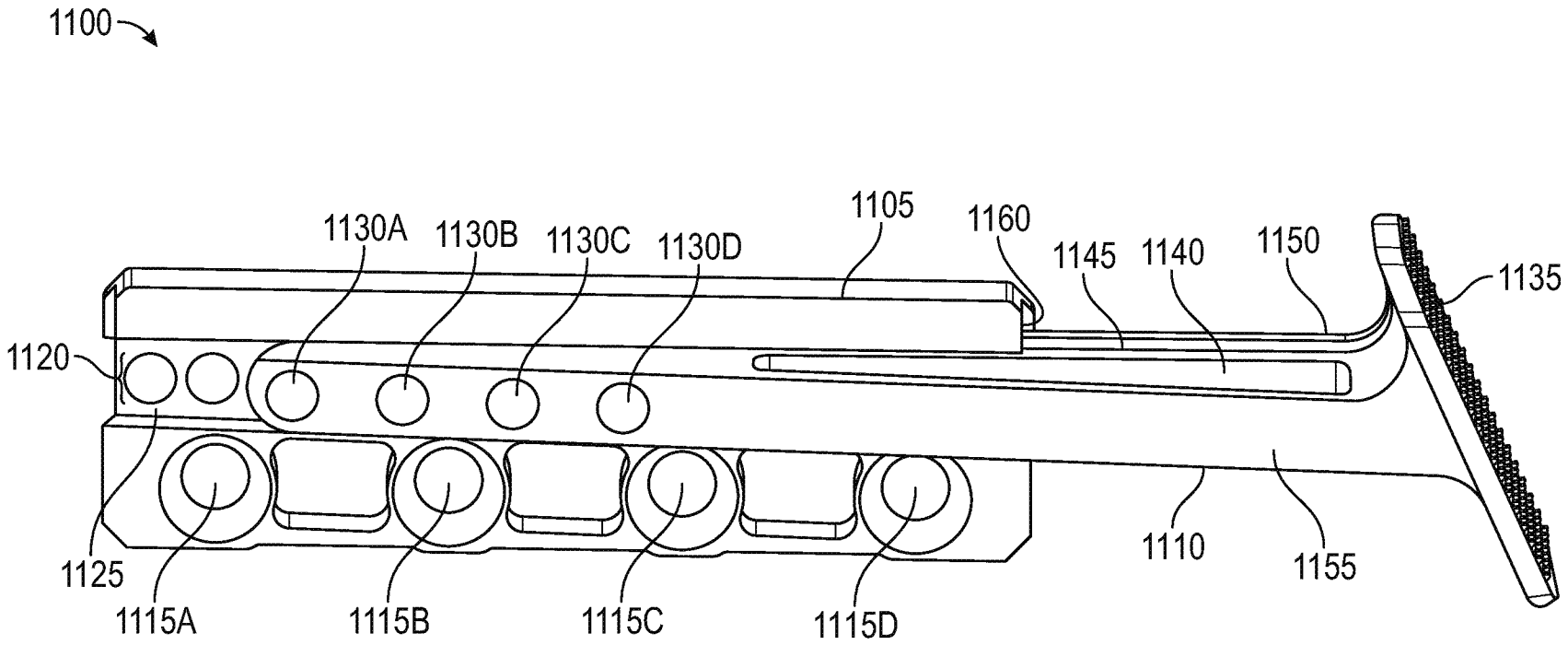
FIG. 11 illustrates a left-side view of a thumb rest.
Figure 12:
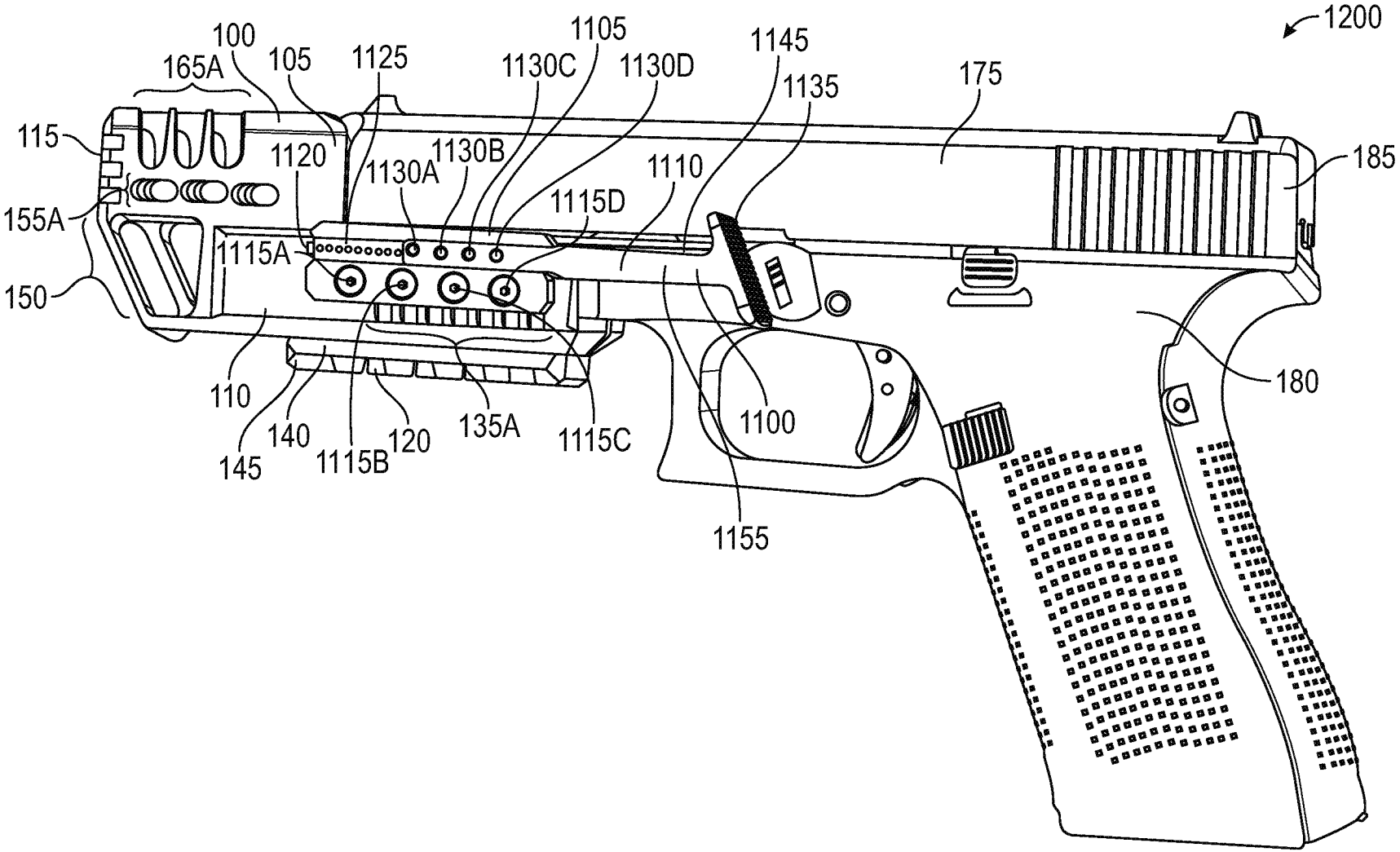
FIG. 12 illustrates a left-side view of a firearm accessory system.

Middle coupling points 930A-B may be disposed between lower rails 940A-B and upper rails 950A-B in mount channels 945A-B. Lower rail 940A may be attached to support 910A and lower rail 940B may be attached to support 910B. Above lower rails, 940A-B may be upper rails 950A-B extending parallel to lower rails 940A-B. Mount channels 945A-B positioned between lower rails 940A-B and upper rails 950A-B and may be sized to receive one or more accessories such as a flashlight, a laser, a thumb rest such as thumb rest 1100 (as seen in FIGS. 11-13), and/or other accessories known in the art. Middle coupling points 930A-B that may be disposed in mount channels 945A-B may facilitate attachment of the various accessories.

Platform 905 may include distal coupling points 955A-B and proximal coupling points 960A-B. Distal and proximal coupling points 955A-B and 960A-B may allow an accessory to be attached to platform 905. The accessory may include a flashlight, laser, and/or optics, etc. Platform 905 may also include shield 915 that extends distally off of platform 905 and may help protect an accessory attached to platform 905 from dust, smoke, gunpowder residue, and other particulate matter potentially harmful to the accessory. First portion 965 of shield 915 may extend outward from platform 905 at a first angle and second portion 970 of shield 915 may extend outward at a second angle. Further, the surface of shield 915 may be textured to facilitate the attachment of one or more accessories to platform 905. Further, the distal end of shield 915 may include a rounded end by smoothing out the edges and removing outside corners to follow the contours of the firearm and/or accessory and facilitating holstering of the firearm.

Figure 10:
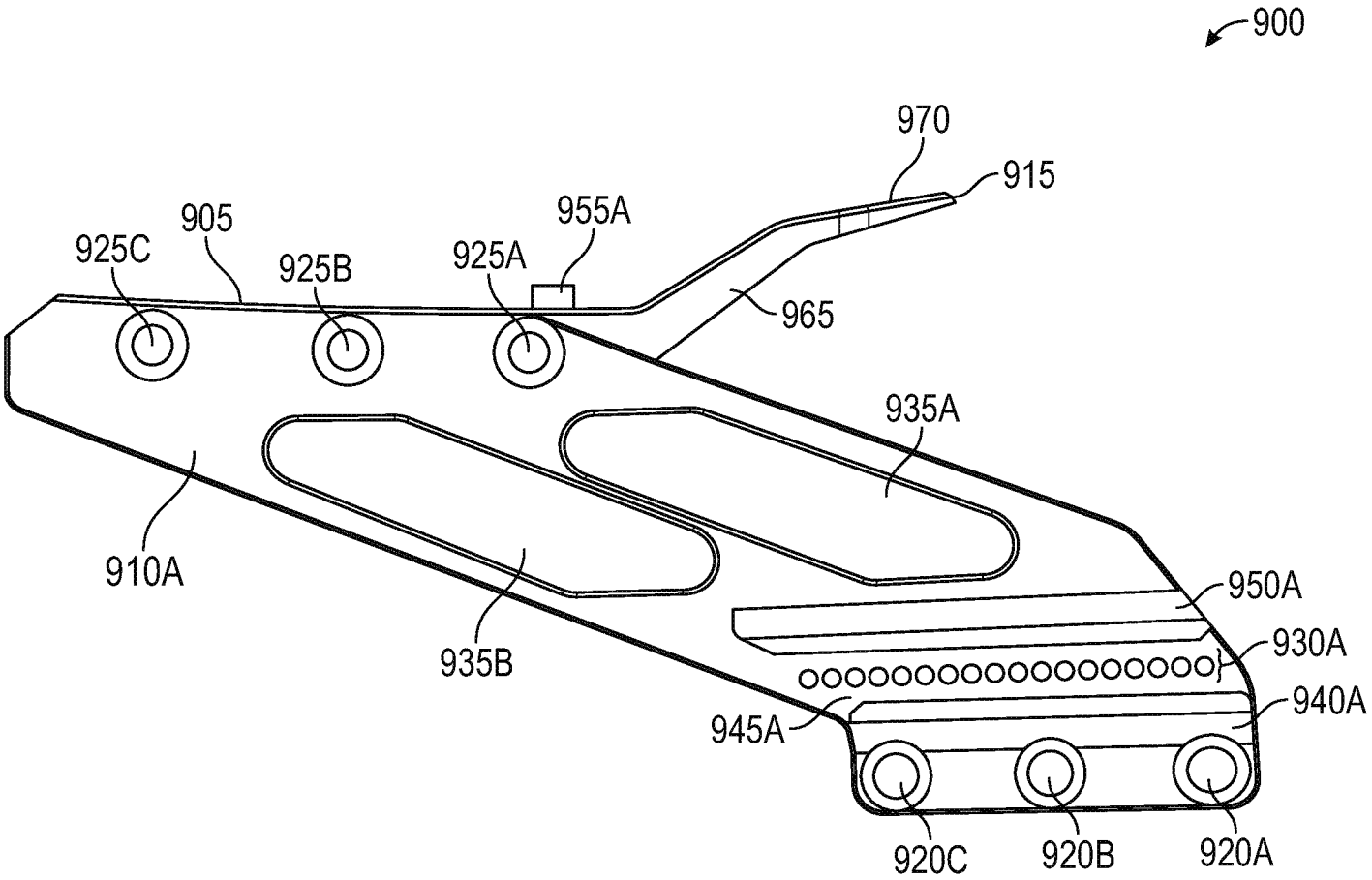
FIG. 10 illustrates a left-side view of a mount.

FIG. 10 illustrates a left-side view of mount 900. Mount 900 may include first support 910A and second support 910B (support 910B not seen due to perspective but depicted in FIGS. 9 and 13). Support 910A may include support apertures 935A-B. Second support 910B may include support apertures 935C-D (as seen in FIGS. 9 and 13). Support apertures 935A-D may help to reduce weight and allow air to flow to and from the firearm. The upper portion of supports 910A-B may attach to platform 905 using upper coupling points 925A-F (upper coupling points 925D-F are not shown due to perspective but are depicted in FIG. 13). The lower end of supports 910A-B may include lower coupling points 920A-F (lower coupling points 920D-F are not shown due to perspective but are depicted in FIG. 13). Lower coupling points 920A-F may facilitate attachment to a firearm.

Middle coupling points 930A-B may be disposed between lower rails 940A-B and upper rails 950A-B in mount channels 945A-B. Lower rail 940A may be attached to support 910A and lower rail 940B may be attached to support 910B. Above lower rails 940A-B may be upper rails 950A-B extending parallel to lower rails 940A-B. Mount channels 945A-B may be positioned between lower rails 940A-B and upper rails 950A-B and may be sized to receive one or more accessories such as a flashlight, a laser, a thumb rest such as thumb rest 1100 (as seen in FIGS. 11-13), and/or other accessories known in the art. Middle coupling points 930A-B that may be disposed in mount channels 945A-B may facilitate attachment of the various accessories.

Platform 905 may include distal coupling points 955A-B and proximal coupling points 960A-B (coupling points 960A-B are not seen due to perspective but are depicted in FIG. 9). Distal and proximal coupling points 955A-B and 960A-B may allow an accessory to be attached to platform 905. The accessory may include a flashlight, laser, optics, and or other accessories known in the art. Platform 905 may also include shield 915 that extends distally off of platform 905 and may help protect an accessory attached to platform 905 from dust, smoke, gunpowder residue, and other particulate matter potentially harmful to the accessory. First portion 965 of shield 915 may extend outward from platform 905 at a first angle and second portion 970 of shield 915 may extend outward at a second angle. Further, the surface of shield 915 may be textured to facilitate the attachment of one or more accessories to platform 905. Further, the distal end of shield 915 may include a rounded end by smoothing out the edges and removing outside corners to follow the contours of the firearm and/or accessory and facilitating holstering of the firearm.

FIG. 11 illustrates a left-side view of a firearm accessory system that includes thumb rest 1100 and compensator 100. Thumb rest 1100 may include plate 1105 and arm 1110. Plate 1105 may include plate junction points 1115A-D. This facilitates the attachment of thumb rest 1100 to a firearm and may be accomplished via compensator 100. Plate 1105 may also include channel 1125. Channel may include one or more grooves that run substantially parallel to channel 1125. Substantial in this context is plus or minus 5%. One or more grooves may provide a track for spine 1150 to slide back and forth making it difficult to fall out laterally. Channel 1125 may also include one or more connector points 1120 to help adjustably secure arm 1110 in a place of choice for the user.

Connector points 1120 may include a plurality of points to allow arm 1110 to be adjustable for different users. Further connector points 1120 are sized to receive a connector through one or more arm junction points 1130A-D.

In addition to arm junction points 1130A-D arm 1110 may include branch 1145 and branch 1155. Branch 1145 may include spine 1150 that may be sized to fit into groove 1160 to help inhibit lateral movement of arm 1110. Groove 1160 may run the length of plate 1105 and create a track for spine 1150 to slide back and forth. Branch 1145 may be located closest to plate 1105. Alternatively, spine 1150 may be positioned on both Branch 1145 and branch 1155 so that the thumb rest 1100 may be positioned on either side of the firearm. Spine 1150 may be positioned at the top and/or the bottom of branch 1145 along with the associated groove at the bottom and/or top of channel 1125. Arm 1110 may also include stage 1135 which may act as a platform to rest the thumb of the user. Stage 1135 may be positioned at an angle with respect to the length of arm 1110 such that the length between the top edge of stage 1135 is at a shorter distance to the distal end of arm 1110 than is the bottom edge of stage 1135. Stage 1135 may further include texture to help stabilize the connection between stage 1135 and the thumb of the user. Branch 1155 may attach to stage 1135 on an outside edge of arm 1110, separated by opening 1140. Branch 1155 may look similar to branch 1145 without spine 1150.

FIG. 12 illustrates a left-side view of a firearm accessory system 1000 including compensator 100 and thumb rest 1100 attached to firearm 175. Compensator 100 includes top section 105 and bottom section 110. Top section 105 may include top vents 165A and 165B (165B not shown due to perspective) and side vents 155A and 155B (155B not shown due to perspective). Vents 165A-B and 155A-B are used to dispel the rush of air created when a bullet is expelled out the muzzle of a firearm and out of muzzle 115. Muzzle 115 opens to the distal end of compensator 100. When attached to firearm 175 top section 105 may be in line with upper section 185 of the firearm such that the muzzle of the firearm is in line with muzzle 115 of compensator 100. At the proximal end of top section 105 may be shaped, such as a curved portion as depicted, to accommodate the shape of the firearm to be attached.

At the distal end of bottom section 110 may include receiver 150 to provide an area of attachment for slings, holsters, optics, or other accessories known in the art. Receiver 150 may include openings on the right, the left, and the front distal end of bottom section 115. When attached to firearm 175 bottom section 110 may be in line with lower section 180 of the firearm receiver 150 may also provide a place within compensator 100 to reduce weight. Proximally to receiver 150 bottom section 110 may include left and right attachment channels 125A-B (channel 125B is not seen due to perspective but depicted in FIG. 2). Channels 125A-B may inset within bottom section 110 such that the outermost edge of bottom section 110 is extended outward at a first level and channels 125A-B are inset at a second level that is extended outward less than the first level. This inset may help align accessories to the appropriate location to facilitate attachment. Within channels 125A-B are attachment ports 130A-N. Attachment ports 130A-G may be disposed in channel 125A. Channels 125A-B may be rounded on both ends and may accommodate a variety of accessories. Attachment ports 130H-N may dispose within channel 125B. Any number of attachment ports 130A-N may be disposed within channels 125A-B. Further, attachment ports 130A-N may be comprised of one or more of threaded, apertures, magnets, and other connectors known in the art.

Bottom section 110 may also include one or more grooves 135A-B for grip and weight reduction. Grooves 135B are not seen in FIG. 1 due to perspective but are depicted in FIG. 2. One or more grooves 135A and 135B may run substantially perpendicular to channels 125A and 125B. Grooves 135A-B may be comprised of two levels outside level and inside level. The outside level may extend outward from the center of bottom section 110 and may be in line with the outside edge of bottom section 115. The inside level may extend inward at a level higher than that of channels 125A-B. Alternatively, a lower-level portion of Grooves 135A-B may be at the same level as channels 125A-B.

The underside of bottom section 110 may include rail 120. Rail 120 may removably attach to bottom section 110 and may include base 140 and grooves 145 that extends outward from bottom section 110. The type of rail 120 may include one or more of a dovetail rail, Warsaw Pact rail, weaver rail, Picatinny rail, NATO accessory rail, or a modular lock rail. Rail 120 may include connecting port that allow rail 120 to removably attach to bottom section 110.

Attached to firearm 175 using one or of lower coupling points 1120A-F is thumb rest 1100. Thumb rest 1100 may include plate 1105 and arm 1110. Plate 1105 may include plate junction points 1115A-D. This facilitates the attachment of thumb rest 1100 to a firearm and may be accomplished via compensator 100. Plate 1105 may also include channel 1125. Channel may include one or more grooves that run substantially parallel to channel 1125. Substantial in this context is plus or minus 5%. One or more grooves may provide a track for spine 1150 to slide back and forth making it difficult to fall out laterally. Channel 1125 may also include one or more connector points 1120 to help adjustably secure arm 1110 in a place of choice for the user. Connector points 1120 may include a plurality of points to allow arm 1110 to be adjustable for different users. Further connector points 1120 are sized to receive a connector through one or more arm junction points 1130A-D.

In addition to arm junction points 1130A-D arm 1110 may include branch 1145 and branch 1155. Branch 1145 may include spine 1150 that may be sized to fit into groove 1160 to help inhibit lateral movement of arm 1110. Groove 1160 may run the length of plate 1105 and create a track for spine 1150 to slide back and forth. Branch 1145 may be located closest to plate 1105. Alternatively, spine 1150 may be positioned on both Branch 1145 and branch 1155 so that the thumb rest 1100 may be positioned on either side of the firearm. Spine 1150 may be positioned at the top and/or the bottom of branch 1145 along with the associated groove at the bottom and/or top of channel 1125. Arm 1110 may also include stage 1135 which may act as a platform to rest the thumb of the user. Stage 1135 may be positioned at an angle with respect to the length of arm 1110 such that the length between the top edge of stage 1135 is at a shorter distance to the distal end of arm 1110 than is the bottom edge of stage 1135. Stage 1135 may further include texture to help stabilize the connection between stage 1135 and the thumb of the user. Branch 1155 may attach to stage 1135 on an outside edge of arm 1110, separated by opening 1140. Branch 1155 may look similar to branch 1145 without spine 1150.

FIG. 13 illustrates a left-side view of thumb rest 1100 with compensator 100, mount 900, and thumb rest 1100. Compensator 100 includes top section 105 and bottom section 115. Top section 105 may include top vents 165A and 165B (165B not shown due to perspective) and side vents 155A and 155B (155B not shown due to perspective). Vents 165A-B and 155A-B are used to dispel the rush of air created when a bullet is expelled out the muzzle of a firearm and out of muzzle 115. Muzzle 115 opens to the distal end of compensator 100. When attached to firearm 175 top section 105 may be in line with upper section 185 of the firearm such that the muzzle of the firearm is in line with muzzle 115 of compensator 100. At the proximal end of top section 105 may be shaped, such as a curved portion as depicted, to accommodate the shape of the firearm to be attached.

At the distal end of bottom section 110 may include receiver 150 to provide an area of attachment for slings, holsters, optics, or other accessories known in the art. Receiver 150 may include openings on the right, the left, and the front distal end of bottom section 115. When attached to firearm 175 bottom section 110 may be in line with lower section 180 of the firearm receiver 150 may also provide a place within compensator 100 to reduce weight. Proximally to receiver 150 bottom section 110 may include left and right attachment channels 125A-B (channel 125B is not seen due to perspective but depicted in FIG. 2). Channels 125A-B may inset within bottom section 110 such that the outermost edge of bottom section 110 is extended outward at a first level and channels 125A-B are inset at a second level that is extended outward less than the first level. This inset may help align accessories to the appropriate location to facilitate attachment. Within channels 125A-B are attachment ports 130A-N. Attachment ports 130A-G may be disposed in channel 125A. Channels 125A-B may be rounded on both ends and may accommodate a variety of accessories. Attachment ports 130H-N may dispose within channel 125B. Any number of attachment ports 130A-N may be disposed within channels 125A-B. Further, attachment ports 130A-N may be comprised of one or more of threaded, apertures, magnets, and other connectors known in the art.

Bottom section 110 may also include one or more grooves 135A-B for grip and weight reduction. Grooves 135B are not seen in FIG. 1 due to perspective but are depicted in FIG. 2. One or more grooves 135A and 135B may run substantially perpendicular to channels 125A and 125B. Grooves 135A-B may be comprised of two levels outside level and inside level. The outside level may extend outward from the center of bottom section 110 and may be in line with the outside edge of bottom section 115. The inside level may extend inward at a level higher than that of channels 125A-B. Alternatively, a lower-level portion of Grooves 135A-B may be at the same level as channels 125A-B.

The underside of bottom section 110 may include rail 120. Rail 120 may removably attach to bottom section 110 and may include base 140 and grooves 145 that extends outward from bottom section 110. The type of rail 120 may include one or more of a dovetail rail, Warsaw Pact rail, weaver rail, Picatinny rail, NATO accessory rail, or a modular lock rail. Rail 120 may include connecting port that allow rail 120 to removably attach to bottom section 110.

Mount 900 may be attached to firearm 175 using one or of lower coupling points 920A-F (lower coupling points 920A-C are depicted in FIGS. 9 and 10). Mount 900 may include first support 910A and second support 910B (support 910A not seen due to perspective but depicted in FIGS. 9 and 10). Support 910A may include support apertures 935A-B. Second support 910B may include support apertures 935C-D. Support apertures 935A-D (support apertures 935A-B seen in FIGS. 9-10) may help to reduce weight and allow air to flow to and from the firearm. The upper portion of supports 910A-B may attach to platform 905 using upper coupling points 925A-F (upper coupling points 925A-C are not shown due to perspective but are depicted in FIGS. 9-10). The lower end of supports 910A-B may include lower coupling points 920A-F (lower coupling points 920A-C are not shown due to perspective but are depicted in FIGS. 9-10). Lower coupling points 920A-F may facilitate attachment to a firearm.

Middle coupling points 930A-B may be disposed between lower rails 940A-B and upper rails 950A-B in mount channels 945A-B. Lower rail 940A may be attached to support 910A and lower rail 940B may be attached to support 910B. Above lower rails 940A-B may be upper rails 950A-B extending parallel to lower rails 940A-B. Mount channels 945A-B may be positioned between lower rails 940A-B and upper rails 950A-B and may be sized to receive one or more accessories such as a flashlight, a laser, a thumb rest such as thumb rest 1100, and/or other accessories known in the art. Middle coupling points 930A-B that may be disposed in mount channels 945A-B may facilitate attachment of the various accessories.

Platform 905 may include distal coupling points 955A-B and proximal coupling points 960A-B (coupling points 960A-B are not seen due to perspective but are depicted in FIG. 9-10). Distal and proximal coupling points 955A-B and 960A-B may allow an accessory to be attached to platform 905. The accessory may include a flashlight, laser, optics, and or other accessories known in the art. Platform 905 may also include shield 915 that extends distally off of platform 905 and may help protect an accessory attached to platform 905 from dust, smoke, gunpowder residue, and other particulate matter potentially harmful to the accessory. First portion 965 of shield 915 may extend outward from platform 905 at a first angle and second portion 970 of shield 915 may extend outward at a second angle. Further, the surface of shield 915 may be textured to facilitate the attachment of one or more accessories to platform 905. Further, the distal end of shield 915 may include a rounded end by smoothing out the edges and removing outside corners to follow the contours of the firearm and/or accessory and facilitating holstering of the firearm.

Thumb rest 1100 may include plate 1105 and arm 1110. Plate 1105 may include plate junction points 1115A-D. This facilitates the attachment of thumb rest 1100 to a firearm and may be accomplished via compensator 100. Plate 1105 may also include channel 1125. Channel may include one or more grooves that run substantially parallel to channel 1125. Substantial in this context is plus or minus 5%. One or more grooves may provide a track for spine 1150 to slide back and forth making it difficult to fall out laterally. Channel 1125 may also include one or more connector points 1120 to help adjustably secure arm 1110 in a place of choice for the user. Connector points 1120 may include a plurality of points to allow arm 1110 to be adjustable for different users. Further connector points 1120 are sized to receive a connector through one or more arm junction points 1130A-D.

In addition to arm junction points 1130A-D arm 1110 may include branch 1145 and branch 1155. Branch 1145 may include spine 1150 that may be sized to fit into groove 1160 to help inhibit lateral movement of arm 1110. Groove 1160 may run the length of plate 1105 and create a track for spine 1150 to slide back and forth. Branch 1145 may be located closest to plate 1105. Alternatively, spine 1150 may be positioned on both Branch 1145 and branch 1155 so that the thumb rest 1100 may be positioned on either side of the firearm. Spine 1150 may be positioned at the top and/or the bottom of branch 1145 along with the associated groove at the bottom and/or top of channel 1125. Arm 1110 may also include stage 1135 which may act as a platform to rest the thumb of the user. Stage 1135 may be positioned at an angle with respect to the length of arm 1110 such that the length between the top edge of stage 1135 is at a shorter distance to the distal end of arm 1110 than is the bottom edge of stage 1135. Stage 1135 may further include texture to help stabilize the connection between stage 1135 and the thumb of the user. Branch 1155 may attach to stage 1135 on an outside edge of arm 1110, separated by opening 1140. Branch 1155 may look similar to branch 1145 without spine 1150.

The foregoing description has been presented for the purposes of illustration and description. It is not intended to be exhaustive or to limit the disclosure to the precise form disclosed. Many modifications and variations are possible in light of the above disclosure and teachings. Further, it should be noted that any or all of the aforementioned alternate implementations may be used in any combination desired to form additional hybrid implementations of the disclosure. For example, components described herein may be removed and other components added without departing from the scope or spirit of the embodiments disclosed herein or the appended claims.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

What is claimed is:

1. A device comprising:
a firearm compensator comprising:
an upper section comprising:
one or more vents,
a muzzle; and
a lower section connected to the upper section and comprising:
a plurality of attachment ports
a rail removably attached to the lower section of the firearm compensator, the rail being attached to a platform, and a key being attached to the platform.

2. The device of claim 1 further comprises:
a channel.

3. The device of claim 2, wherein the plurality of attachment ports are disposed within the channel.

4. The device of claim 3, wherein the channel is inset from the outside edge of the firearm compensator.

5. A system, comprising:
a firearm compensator comprising:
an upper section comprising:
one or more vents,
a muzzle;
a lower section connected to the upper section comprising:
one or more attachment ports;
a mount removably attached to the firearm compensator comprising:
a platform comprising:
one or more coupling points, and
one or more supports attached to the platform comprising:
one or more coupling points removably attached to the one or more attachment ports of the firearm compressor.

6. The system of claim 5, further comprises:
a channel.

7. The system of claim 6, wherein the one or more attachment ports are disposed within the channel.

8. The system of claim 7, wherein the channel is inset from the outside edge of the firearm compensator.

9. The system of claim 5, further comprises a thumb rest.

10. The system of claim 9, wherein the thumb rest is removably attached to the mount.

11. The system of claim 5, wherein the platform further comprises:
a shield.

12. A system, comprising:
a firearm compensator comprising:
an upper section comprising:
one or more vents,
a muzzle;
a lower section connected to the upper section comprising:
one or more attachment ports;
a thumb rest comprising:
an arm comprising:
a stage, and
one or more arm junction points.

13. The system of claim 12, further comprises:
a channel disposed in the lower section of the compensator.

14. The system of claim 13, wherein the one or more attachment ports are disposed within the channel.

15. The system of claim 14, wherein the channel is inset from the outside edge of the firearm compensator.

16. The system of claim 12, wherein the thumb rest further comprises:
a plate.

17. The system of claim 12, further comprises: a mount.

* * * * *